US011155989B1

(12) United States Patent
Mou et al.

(10) Patent No.: US 11,155,989 B1
(45) Date of Patent: Oct. 26, 2021

(54) DOUBLE-STEEL TUBE CONCRETE BEAM-COLUMN JOINT WITH INTERNAL FIBER REINFORCED POLYMER (FRP) BAR CONNECTORS AND ASSEMBLY METHOD

(71) Applicant: QINGDAO UNIVERSITY OF TECHNOLOGY, Qingdao (CN)

(72) Inventors: Ben Mou, Qingdao (CN); Zuquan Jin, Qingdao (CN); Wanqiu Zhou, Qingdao (CN); Wenfeng Liu, Qingdao (CN); Tao Yu, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 17/234,827

(22) Filed: Apr. 20, 2021

(30) Foreign Application Priority Data

Jul. 13, 2020 (CN) ..... 202010668304.0

(51) Int. Cl.
*E04B 1/24* (2006.01)
*E04B 1/30* (2006.01)

(52) U.S. Cl.
CPC ..... *E04B 1/2403* (2013.01); *E04B 1/30* (2013.01); *E04B 2001/2415* (2013.01); *E04B 2001/2418* (2013.01); *E04B 2001/2451* (2013.01); *E04B 2001/2478* (2013.01)

(58) Field of Classification Search
CPC .. E04B 1/2403; E04B 1/30; E04B 2001/2418; E04B 2001/2451; E04B 2001/2478; E04B 2001/2415
See application file for complete search history.

(56) References Cited

U.S. PATENT DOCUMENTS 4,722,156 A * 2/1988 Sato ..... E04C 3/34 52/98
9,267,286 B2 * 2/2016 Kim ..... B28B 21/56
9,637,923 B2 * 5/2017 Radhouane ..... E04H 12/2292
10,167,623 B2 * 1/2019 Mou ..... E04B 1/2403
(Continued)

FOREIGN PATENT DOCUMENTS

CN 202831235 U * 3/2013 ..... E04B 1/5812
CN 105804246 A * 7/2016
(Continued)

*Primary Examiner* — Rodney Mintz
(74) *Attorney, Agent, or Firm* — Bayramoglu Law Offices LLC

(57) ABSTRACT

A double-steel tube concrete beam-column joint with internal FRP bar connectors is provided. The double-steel tube concrete beam-column joint includes double-steel tube columns, I-beams, a joint connector, an internal support member and external ring plates. Each double-steel tube column includes an internal steel tube and an external steel tube. The joint connector includes an internal connecting tube and an external connecting sleeve which are both circular steel tubes. The internal support member is a columnar structure and has two ends regularly formed with bolt holes in a circumferential direction. Each external ring plate comprises a horizontal portion and an annular portion perpendicular to the horizontal portion. Upper and lower double-steel tube columns are connected through the joint connector and the internal support member, the two ends of the internal support member are inserted into an upper internal steel tube and a lower internal steel tube, respectively.

16 Claims, 7 Drawing Sheets

(56) References Cited

U.S. PATENT DOCUMENTS

| | | | | |
|---|---|---|---|---|
| 10,253,492 | B2 * | 4/2019 | Uno | E04B 1/24 |
| 10,344,480 | B2 * | 7/2019 | Azizinamini | E04G 13/04 |
| 10,378,208 | B2 * | 8/2019 | Sun | E04C 3/36 |
| 10,633,851 | B2 * | 4/2020 | Mou | E04B 1/21 |
| 10,851,537 | B2 * | 12/2020 | Zhang | E04B 1/2403 |
| 10,876,282 | B1 * | 12/2020 | Mou | E04B 1/2604 |
| 10,954,663 | B2 * | 3/2021 | Mou | E04B 1/58 |
| 10,961,696 | B2 * | 3/2021 | Mou | G01M 5/0083 |
| 2006/0265992 | A1 * | 11/2006 | Hiragaki | E04B 5/43 52/633 |
| 2012/0124937 | A1 * | 5/2012 | Teng | E04B 5/43 52/834 |
| 2015/0113913 | A1 * | 4/2015 | Kim | E04C 3/34 52/834 |
| 2016/0258160 | A1 * | 9/2016 | Radhouane | E04H 12/2292 |
| 2017/0241140 | A1 * | 8/2017 | Teng | B29C 70/52 |
| 2018/0187407 | A1 * | 7/2018 | Mou | E04B 1/2403 |
| 2018/0223521 | A1 * | 8/2018 | Uno | E04B 1/5812 |
| 2018/0305929 | A1 * | 10/2018 | Sun | E04C 3/36 |
| 2019/0169846 | A1 * | 6/2019 | Azizinamini | E04B 5/19 |
| 2019/0271144 | A1 * | 9/2019 | Zhang | E04B 1/185 |
| 2019/0376273 | A1 * | 12/2019 | Mou | E04B 1/2403 |
| 2021/0025159 | A1 * | 1/2021 | Mou | E04B 1/58 |
| 2021/0047825 | A1 * | 2/2021 | Mou | E04H 9/024 |

FOREIGN PATENT DOCUMENTS

| | | | | | |
|---|---|---|---|---|---|
| CN | 206205158 | U | * | 5/2017 | |
| CN | 207160238 | U | * | 3/2018 | |
| CN | 107893481 | A | * | 4/2018 | |
| CN | 207582727 | U | * | 7/2018 | |
| CN | 207919763 | U | * | 9/2018 | |
| CN | 110295670 | A | * | 10/2019 | |
| JP | 2003343008 | A | * | 12/2003 | E04B 1/58 |
| WO | WO-2016056696 | A1 | * | 4/2016 | E04B 1/58 |
| WO | WO-2017026113 | A1 | * | 2/2017 | E04B 1/5812 |

* cited by examiner

DOUBLE-STEEL TUBE CONCRETE BEAM-COLUMN JOINT WITH INTERNAL FIBER REINFORCED POLYMER (FRP) BAR CONNECTORS AND ASSEMBLY METHOD

CROSS REFERENCES TO THE RELATED APPLICATIONS

This application is based upon and claims priority to Chinese Patent Application No. 202010668304.0, filed on Jul. 13, 2020, the entire contents of which are incorporated herein by reference.

TECHNICAL FIELD

The invention relates to the field of building structures, in particular to a double-steel tube concrete beam-column joint with internal FRP bar connectors and an assembly method.

BACKGROUND

With the continuous development of social modernization, building structures are becoming higher and larger, and steel tube concrete columns with good structural performance have been widely applied to high-rise and ultrahigh-rise buildings, wherein double-steel tube concrete columns not only can effectively reduce the weight of the structures, but also have extremely good mechanical properties, thus possessing great development potentials and practicability.

Double-tube concrete column joints are key connection parts between columns and between beams and columns and are of great importance for the safety and structural performance of the whole structure. At present, the steel tubes are mostly directly welded, which puts forward high construction requirements on the welding field, makes it difficult to control the quality, and leads to high welding residual stress; and in case of an earthquake, the steel tubes may be partially buckled, which leads to excessive deformation of the joints and failures of the structures.

SUMMARY

One objective of the invention is to overcome the defects of the existing connection manner of double-steel tube concrete beam-column joints by providing a double-steel tube concrete beam-column joint with internal FRP bar connectors.

To fulfill the above objective, the double-steel tube concrete beam-column joint with internal FRP bar connectors comprises double-steel tube columns, I-beams, a joint connector, an internal support member and external ring plates;

Each double-steel tube column comprises an internal steel tube and an external steel tube, the internal steel tubes are disposed in the external steel tubes, and connecting lugs I are perpendicularly and fixedly disposed at near-joint ends of outer sides of the external steel tubes;

The joint connector comprises an internal connecting tube and an external connecting sleeve which are both circular steel tubes, the inner connecting tube is disposed in the external connecting sleeve and is connected to the external connecting sleeve through bar connectors, two ends of the internal connecting tube stretch out of the external connecting sleeve and are formed with through holes, the inner diameter of the external connecting sleeve is greater than the outer diameter of the external steel tubes, connecting lugs II are perpendicularly and fixedly disposed in the middle of an outer side of the external connecting sleeve, and grooves are formed in the external connecting sleeve and are located above and below the connecting lugs II, respectively;

The internal support member is a columnar structure and has two ends regularly formed with bolt holes in the circumferential direction;

Each external ring plate comprises a horizontal portion and an annular portion perpendicular to the horizontal portion;

The upper and lower double-steel tube columns are connected through the joint connector and the internal support member, the two ends of the internal support member are inserted into the upper and lower internal steel tubes, respectively, the upper and lower internal steel tubes are inserted into the internal connecting tube, the upper and lower external steel tubes are inserted into the external connecting sleeve, and the connecting lugs I are inserted into the grooves;

The double-steel tube columns and the I-beams are connected through two sets of external ring plates that are vertically symmetrical, the annular portions of the external ring plates are attached to the external steel tubes, FRP bars sequentially penetrate through the annular portions, the external steel tubes, the internal connecting tube and the internal steel tubes to be fixed in the bolt holes of the internal support member, webs of the I-beams are fixedly connected to the connecting lugs I and the connecting lugs II, and flanges of the I-beams are fixedly connected to the horizontal portions.

Preferably, the webs of the I-beams are connected to the connecting lugs I and the connecting lugs II through connecting plates I, and the webs, the connecting lugs 1 and the connecting lugs II are fixed with bolts, so that the webs are connected, and the connection of the upper and lower external steel tubes is enhanced.

Preferably, the flanges of the I-beams are connected to the horizontal portions (51) through connecting plates II, and the flanges and the horizontal portions are fixed with bolts.

Preferably, two ends of each FRP bar are tapped with external threads, one end of each FRP bar is connected to the internal support member in a threaded manner, and a nut is disposed at the other end of each FRP bar.

Preferably, the internal support member comprises circular components at the two ends and a connecting rod in the middle, the circular components at the two ends are connected through the connecting rod, and the bolt holes are regularly formed in the circular components in the circumferential direction.

Preferably, the internal support member is as high as the internal connecting tube, and the bolt holes in the two ends of the internal support member correspond to the through holes in the two ends of the internal connecting tube.

FRP is a high-quality plastic composite, and preferably, the FRP bars are made of carbon fiber reinforced composites.

Preferably, concrete poured into the double-steel tube columns is steel fiber reinforced concrete.

Another objective of the invention is to provide an assembly method of the joint, comprising the following steps:

First, assembling the joint connector above the lower double-steel tube column to insert the internal steel tube into the internal connecting tube, insert the external steel tube into the external connecting sleeve and insert the connecting lugs I of the external steel tube into the grooves of the external connecting sleeve;

Second, assembling the bottom of the internal support member in the internal steel tube of the lower double-steel tube column, and enabling the FRP bars to sequentially penetrate through the external steel tube, the internal connecting tube and the internal steel tube to be screwed into the bolt holes in the lower portion of the internal support member;

Third, assembling the upper double-steel tube column above the joint connector to insert an upper end of the internal support member into the upper internal steel tube, insert a lower end of the upper internal steel tube into an upper end of the internal connecting tube, insert the upper external steel tube into an upper end of the external connecting sleeve and insert the connecting lugs I of the external steel tube into the grooves in the upper end of the external connecting sleeve, and enabling the FRP bars to sequentially penetrate through the upper external steel tube, the internal connecting tube and the internal steel tube to be screwed in the bolt holes in the upper portion of the internal support member;

Fourth, connecting each connecting lug II and the corresponding upper and lower connecting lugs I through one connecting plate I, so that the upper and lower double-steel tube columns are connected;

Fifth, pouring concrete into the double-steel tube columns, wherein the concrete poured into the double-steel tube columns is steel fiber reinforced concrete, so that cracks in the concrete can be reduced;

Sixth, assembling two sets of external ring plates vertically symmetrically, connecting the annular portions of the external ring plates to the external steel tubes through the FRP bars, and assembling the nuts at the ends of the FRP bars; and Seventh, assembling the I-beams, and connecting the flanges to the horizontal portions of the external ring plates through the connecting plates II, and connecting the webs to the connecting plates I.

The invention has the following beneficial effects:

(1) The internal support member improves the strength of the joint and can internally support the joint, so that buckling of internal steel tubes is prevented; a "bamboo" effect is formed in the double-steel tube columns, so that the overall strength of columns is improved;

(2) The carbon fiber FRP bars enhance the connection between the concrete and the double-steel tube columns;

(3) By means of the connecting lugs, the connection manner that beams and columns are separately connected to a joint connector in the middle is replaced with the connection manner that beam webs and upper and lower columns are all connected to the joint to bear a vertical load at beam end, and the upper and lower columns are connected and fixed to the joint connector, so that vertical connection of the columns is greatly enhanced, and the integrity and strength of the joint are improved;

(4) By means of the excellent tensile property and the fatigue load resistance of the FRP bars, the anti-seismic and energy-dissipating capacity of the joint is effectively improved; carbon fiber concrete is used, so that cracks in the concrete are reduced, the shear resistance is improved, and the safety and bearing capacity of structures are improved.

Reference signs in the figures: 1. double-steel tube column; 11. internal steel tube; 12. external steel tube; 13. connecting lug I; 2. I-beam; 3. joint connector; 31. internal connecting tube; 32. external connecting sleeve; 33. bar connector; 34. connecting lug II; 35. groove; 4. internal support member; 41. circular component; 42. connecting rod; 5. external ring plate; 51. horizontal portion; 52. annular portion; 53. connecting plate I; 54. connecting plate II.

DETAILED DESCRIPTION OF THE EMBODIMENTS

The invention will be further described below in conjunction with the accompanying drawings.

Embodiment 1

Figure 1:
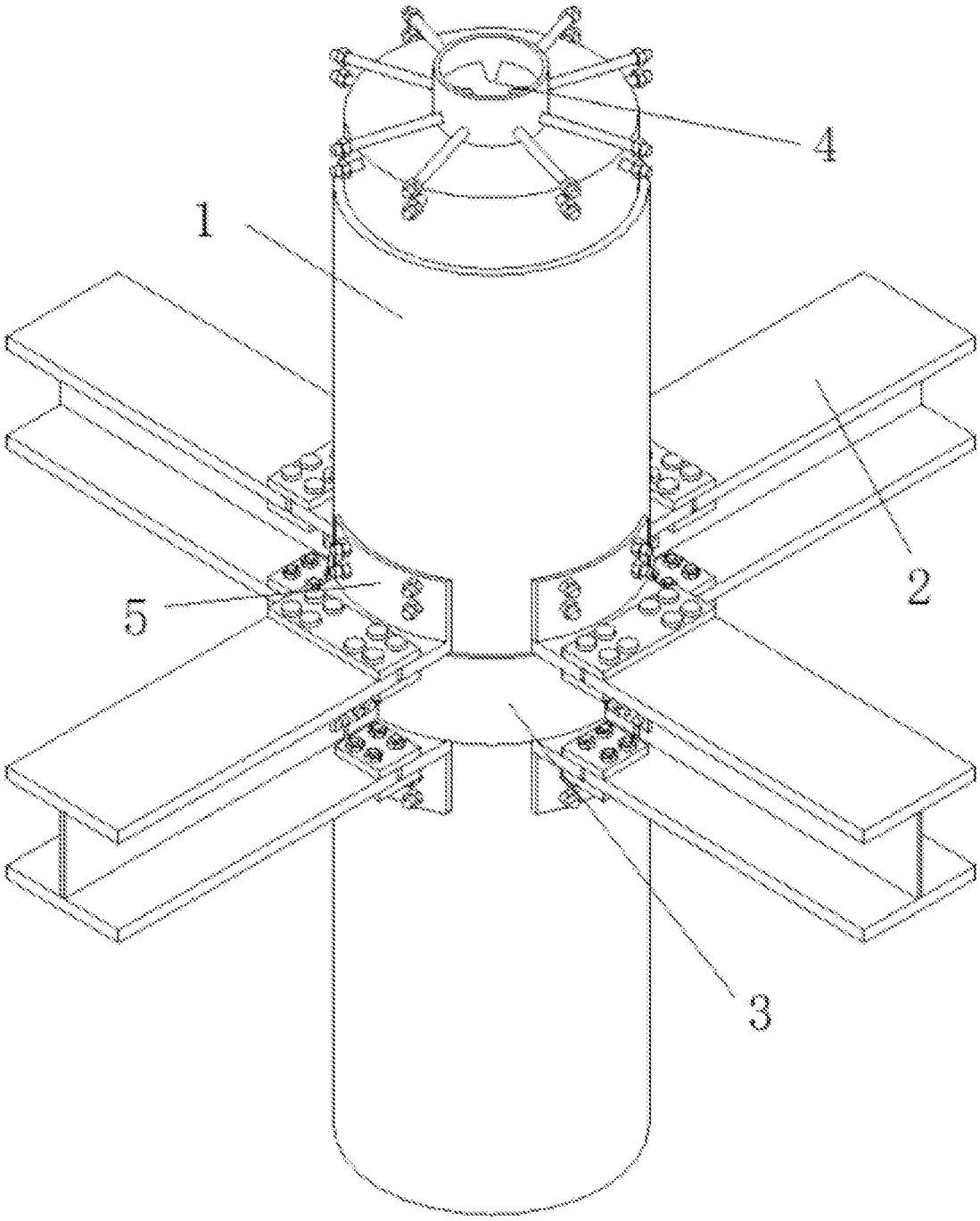
FIG. 1 is a structural diagram of the invention.

As shown in FIG. 1, a double-steel tube concrete beam-column joint with internal FRP bar connectors comprises double-steel tube columns 1, I-beams 2, a joint connector 3, an internal support member 4 and external ring plates 5.

Figure 2:
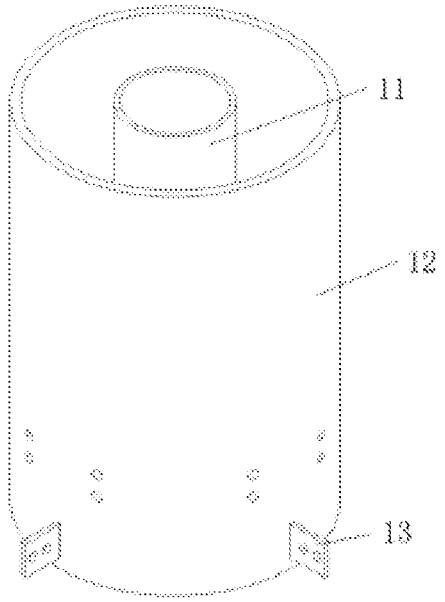
FIG. 2 is a structural diagram of a double-steel tube column.

As shown in FIG. 2, each double-steel tube column 1 comprises an internal steel tube 11 and an external steel tube 12 which are both circular steel tubes, connecting lugs I 13 are perpendicularly and fixedly disposed at near-joint ends of the external steel tubes, that is, the connecting lugs I 13 are perpendicularly and fixedly disposed on external surfaces of the bottom of the upper external steel tube and the top of the lower external steel tube, and the number of the connecting lugs I 13 is equal to the number of the I-beams 2 to be connected to the connecting lugs I 13. For example, four connecting lugs I 13 are connected to four I-beams 2 and are regularly distributed in the circumferential direction, in this embodiment. FRP bar through holes for connection are formed in the bottom of the upper external steel tube and the top of the lower external steel tube.

Figure 3:
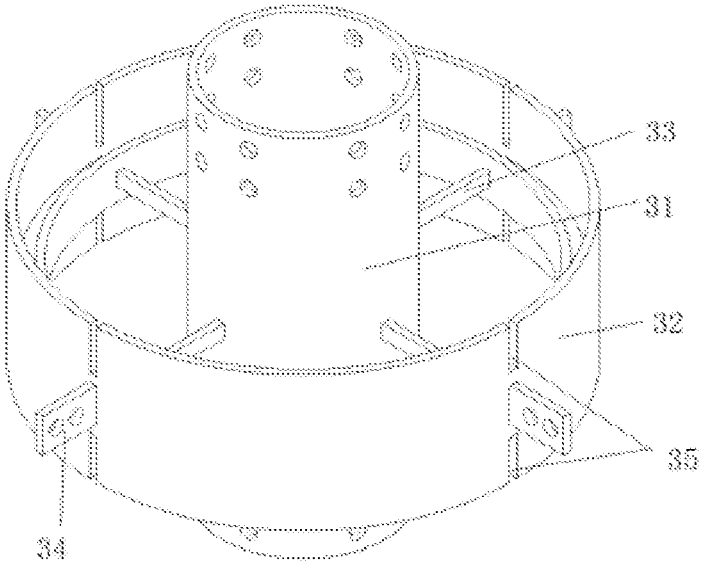
FIG. 3 is a structural diagram of a joint connector.

As shown in FIG. 3, the joint connector 3 comprises an internal connecting tube 31 and an external connecting sleeve 32, wherein the internal connecting tube and the external connecting sleeve are both circular steel tubes and are connected through bar connectors 33, two ends of the internal connecting tube 31 stretch out of the external connecting sleeve 32 and are formed with through holes, the inner diameter of the external connecting sleeve 32 is greater than the outer diameter of the external steel tubes 12, connecting lugs II 34 are perpendicularly fixed to the external connecting sleeve 32, and grooves 35 are formed in the external connecting sleeve and are located above and below the connecting lugs II 34, respectively.

Figure 4:
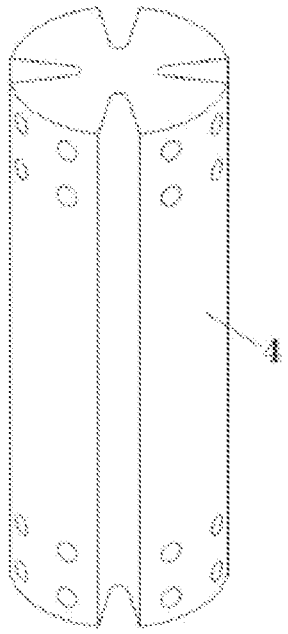
FIG. 4 is a first structural diagram of an internal support member.

As shown in FIG. 4, the internal support member 4 is a columnar structure, and bolt holes are formed in two ends of the internal support member 4 in the circumferential direction, and to save materials and reduce the weight, a groove may be formed in the periphery of the internal support member.

The internal support member 4 is as high as the internal connecting tube 31, and the bolt holes in the two ends of the internal support member 4 correspond to the through holes in the two ends of the internal connecting tube 31.

Figure 6:
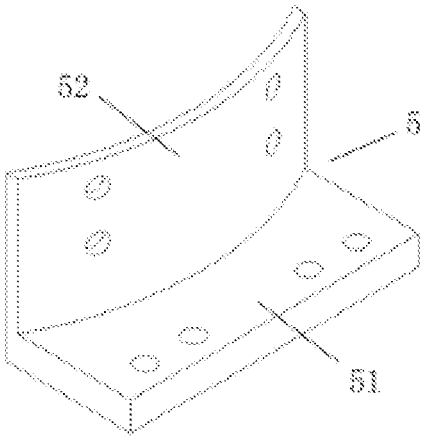
FIG. 6 is a structural diagram of an external ring plate.

As shown in FIG. 6, each external ring plate 5 comprises a horizontal portion 51 and an annular portion 52 perpendicular to the horizontal portion 51.

Figure 7:
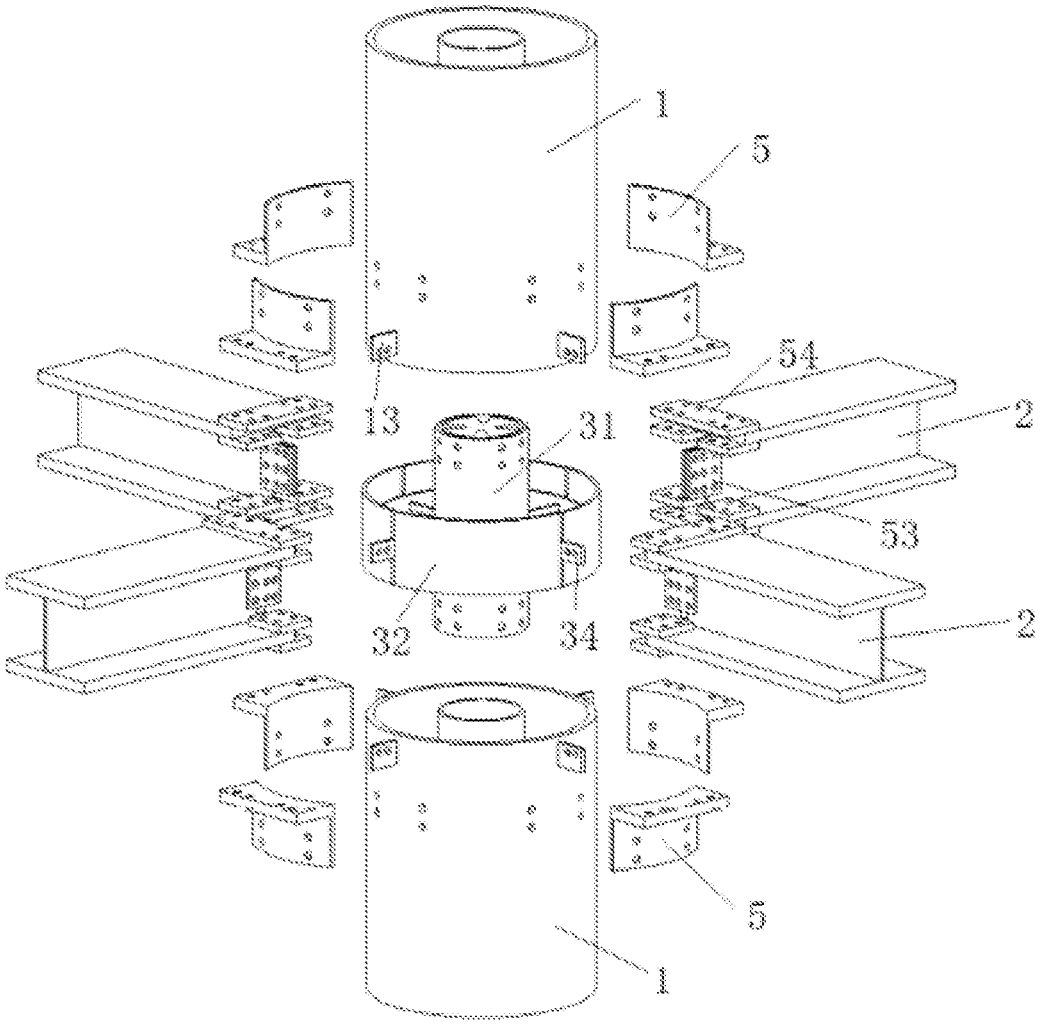
FIG. 7 is an exploded view of the invention.
Figure 8:
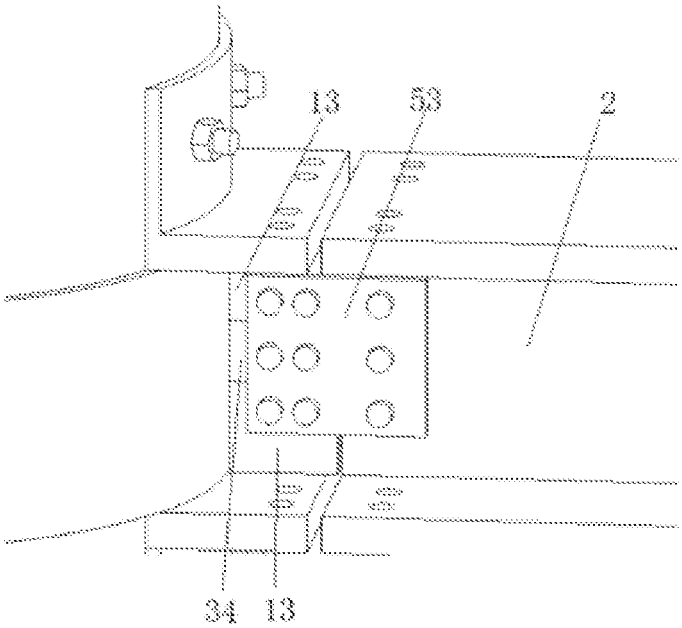
FIG. 8 is a first partial connection diagram of the invention.
Figure 9:
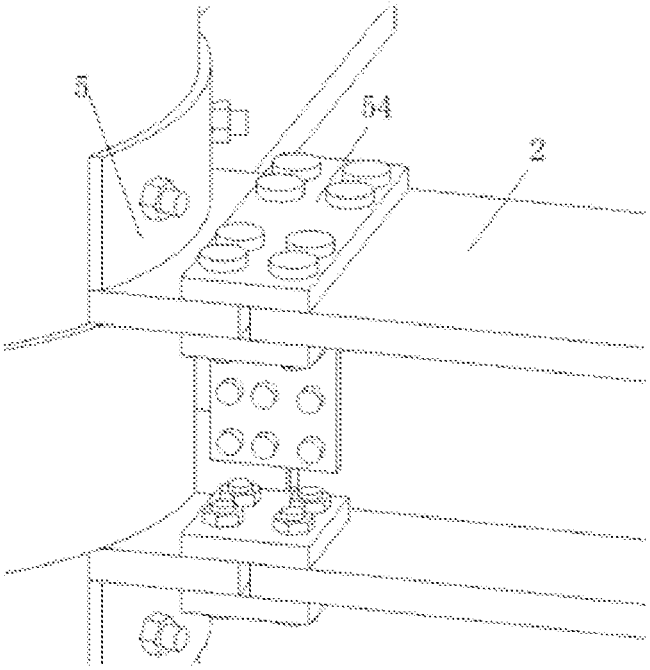
FIG. 9 is a second partial connection diagram of the invention.

As shown in FIG. 7-FIG. 9, the upper and lower double-steel tube columns 1 are connected through the joint connector 3 and the internal support member 4, the internal support member 4 is inserted into the internal connecting tube 31, the lower end of the upper internal steel tube 11 and the upper end of the lower internal steel tube 11 are inserted into a gap between the internal support tube 4 and the internal connecting tube 31, the external steel tubes 12 are inserted into the external connecting sleeve 32 to enable the connecting lugs I 13 to be inserted into the grooves 35 of the external connecting sleeve, the double-steel tube columns 1 and the I-beams 2 are connected through two sets of external ring plates 5 that vertically symmetrical, the annular portions of the external ring plates 5 are attached to the outer surfaces of the external steel tubes 12, FRP bars sequentially penetrate through the annular portions 52 of the external ring plates, the external steel tubes 12, the inner connecting tube 31 and the internal steel tubes 11 to be fixed in the bolt holes in the internal support member 4, two ends of each FRP bar are tapped with external threads, one end of each FRP bar is connected to the internal support member 4 in a threaded manner, and a nut is mounted at the other end of each FRP bar. Webs of the I-beams 2 are connected to the connecting lugs 113 and the connecting lugs II 34 through connecting plates I 53, and the connecting plates I 53 are connected to the webs of the I-beams, the connecting lugs I and the connecting lugs II through bolts, such that the webs are connected, and the connection of the upper external steel tube and the lower external steel tube is enhanced; and flanges of the I-beams 2 are connected to the horizontal portions 51 of the external ring plates through connecting plates II 54, and the connecting plates II 54 are connected to the flanges of the I-beams and the horizontal portions of the external ring plates through bolts.

The FRP bars are made of carbon fiber reinforced composites.

Figure 10:
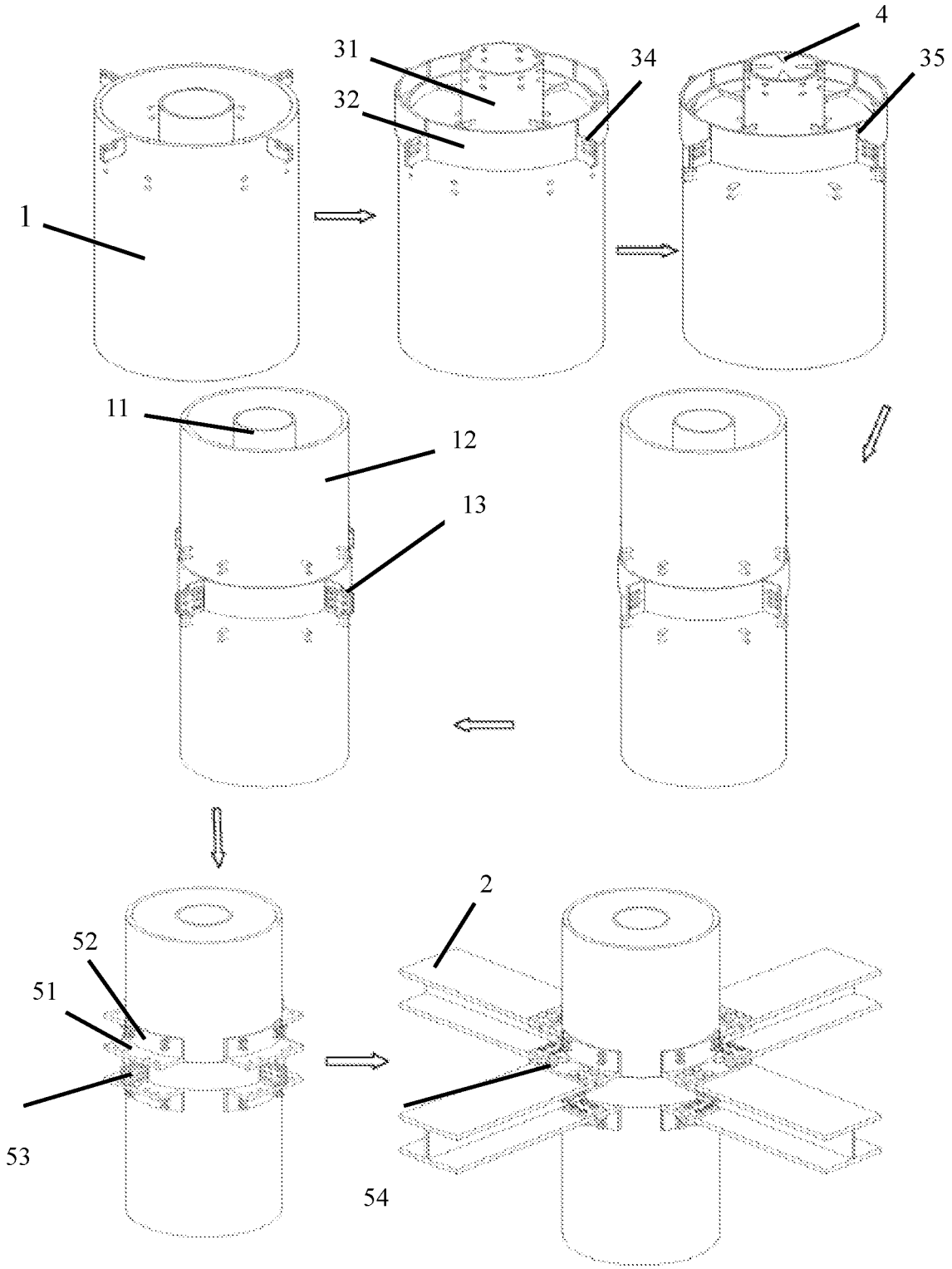
FIG. 10 is an assembly step diagram.

As shown in FIG. 10, an assembly method of the double-steel tube concrete beam-column joint with internal FRP bar connectors comprises the following steps:

First, the joint connector 3 is assembled above the lower double-steel tube column 1 to insert the internal steel pipe 11 into the internal connecting tube 31, insert the external steel pipe 12 into the external connecting sleeve 32 and insert the connecting lugs 113 of the external steel tube into the grooves 35 of the external connecting sleeve;

Second, the bottom of the internal support member 4 is assembled in the internal steel tube 11 of the lower double-steel tube column, and the FRP bars sequentially penetrate through the external steel tube 12, the internal connecting tube 31 and the internal steel tube 11 to be screwed into threaded holes below the internal support member 4;

Third, the upper double-steel tube column 1 is assembled above the joint connector 3 to insert the upper end of the internal support member 4 into the upper internal steel tube 11, insert the lower end of the upper internal steel tube 11 into the upper end of the internal connecting tube 31, insert the upper external steel tube 12 into the upper end of the external connecting sleeve 32 and insert the connecting lugs I 13 of the external steel tube into the grooves 35 of the external connecting sleeve, and the FRP bars sequentially penetrate through the external steel tube 12, the internal connecting tube 31 and the internal steel tube 11 to be screwed into threaded holes above the internal support member 4.

Fourth, each connecting lug II 34 and the corresponding upper and lower connecting lugs I 13 are connected through one connecting plate I 53, so that the upper and lower double-steel tube columns 1 are connected;

Fifth, concrete is poured into the double-steel tube columns 1, wherein the concrete poured into the double-steel tube columns 1 is steel fiber reinforced concrete, so that cracks in the concrete can be reduced;

Sixth, two sets of external ring plates 5 are assembled vertically symmetrically, the annular portions 52 of the external ring plates are connected to the external steel tubes 12 through the FRP bars, and the nuts are assembled at the ends of the FRP bars; and Seventh, the I-beams 2 are assembled, the flanges are connected to the horizontal portions 51 through the connecting plates II 54, and the webs are connected to the connecting plates I 53.

Embodiment 2

Figure 5:
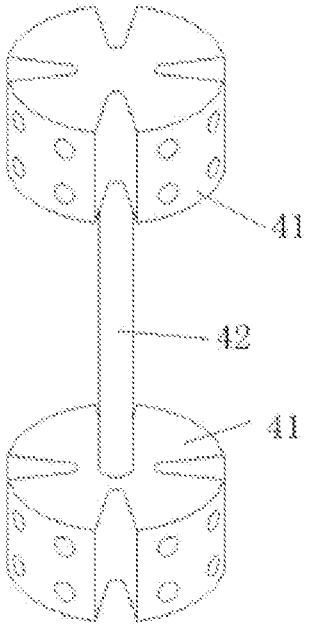
FIG. 5 is a second structural diagram of the internal support member.

As shown in FIG. 5, to save materials and reduce the weight, the middle of the internal support member 4 is hollowed out, and the two ends formed with bolt holes are reserved; the internal support member 4 comprises circular components 41 at the two ends and a connecting rod 42 in the middle, the circular components 41 at the two ends are connected through the connecting rod 42, and bolt holes are regularly formed in the circular components 41 in the circumferential direction.

This embodiment is identical with Embodiment 1 in other aspects.

The above embodiments are merely preferred ones of the invention, and are not intended to limit the invention. Those skilled in the art can make different modifications and alterations to the invention. Any amendments, equivalent substitutions and improvements obtained based on the spirit and principle of the invention should also fall within the protection scope of the invention.

What is claimed is:

1. A double-steel tube concrete beam-column joint with internal fiber reinforced polymer (FRP) bar connectors, comprising:

double-steel tube columns, I-beams, a joint connector, an internal support member and external ring plates;

each double-steel tube column comprises an internal steel tube and an external steel tube, the internal steel tubes are disposed in the external steel tubes, and first connecting lugs are perpendicularly and fixedly disposed at near-joint ends of outer sides of the external steel tubes;

the joint connector comprises an internal connecting tube and an external connecting sleeve, wherein the internal connecting tube and the external connecting sleeve are both circular steel tubes, the internal connecting tube is disposed in the external connecting sleeve and the internal connecting tube is connected to the external connecting sleeve through the bar connectors, two ends of the internal connecting tube stretch out of the external connecting sleeve and are formed with through holes, an inner diameter of the external connecting sleeve is greater than an outer diameter of the external steel tubes, second connecting lugs are perpendicularly and fixedly disposed in a middle of an outer side of the external connecting sleeve, and grooves are formed in the external connecting sleeve and the grooves are located above and below the second connecting lugs, respectively;

the internal support member is a columnar structure and two ends of the internal support member is regularly formed with bolt holes in a circumferential direction;

each external ring plate comprises a horizontal portion and an annular portion perpendicular to the horizontal portion;

the double-steel tube columns are connected through the joint connector and the internal support member, the two ends of the internal support member are inserted into the internal steel tubes, respectively, the internal steel tubes are inserted into the internal connecting tube, the external steel tubes are inserted into the external connecting sleeve, and the first connecting lugs are inserted into the grooves;

the double-steel tube columns and the I-beams are connected through two sets of said external ring plates, wherein the two sets of external ring plates are vertically symmetrical, annular portions of the two sets of the external ring plates are attached to the external steel tubes, FRP bars sequentially penetrate through the annular portions, the external steel tubes, the internal connecting tube and the internal steel tubes to be fixed in the bolt holes of the internal support member, webs of the I-beams are fixedly connected to the first connecting lugs and the second connecting lugs, and flanges of the I-beams are fixedly connected to the horizontal portions.

2. The double-steel tube concrete beam-column joint with the internal FRP bar connectors according to claim 1, wherein the webs of the I-beams are connected to the first connecting lugs and the second connecting lugs through first connecting plates.

3. The double-steel tube concrete beam-column joint with the internal FRP bar connectors according to claim 1, wherein the flanges of the I-beams are connected to the horizontal portions through second connecting plates.

4. The double-steel tube concrete beam-column joint with the internal FRP bar connectors according to claim 1, wherein two ends of each FRP bar are tapped with external threads, a first end of the each FRP bar is connected to the internal support member in a threaded manner, and a nut is mounted at a second end of the each FRP bar.

5. The double-steel tube concrete beam-column joint with the internal FRP bar connectors according to claim 1, wherein the FRP bars are made of carbon fiber reinforced composites.

6. The double-steel tube concrete beam-column joint with the internal FRP bar connectors according to claim 1, wherein concrete poured into the double-steel tube columns after assembly is steel fiber reinforced concrete.

7. The double-steel tube concrete beam-column joint with the internal FRP bar connectors according to claim 1, wherein the internal support member is as high as the internal connecting tube, and the bolt holes in the two ends of the internal support member correspond to the through holes in the two ends of the internal connecting tube.

8. The double-steel tube concrete beam-column joint with the internal FRP bar connectors according to claim 7, wherein the internal support member comprises circular components at the two ends and a connecting rod in a middle, the circular components at the two ends are connected through the connecting rod, and the bolt holes are regularly formed in the circular components in the circumferential direction.

9. An assembly method of the double-steel tube concrete beam-column joint with the internal FRP bar connectors according to claim 1, comprising:

first, assembling the joint connector above a lower double-steel tube column of the double-steel tube columns to insert the internal steel tube into the internal connecting tube, insert the external steel tube into the external connecting sleeve and insert the first connecting lugs of the external steel tube into the grooves of the external connecting sleeve;

second, assembling a bottom of the internal support member in the internal steel tube of the lower double-steel tube column, and enabling the FRP bars to sequentially penetrate through the external steel tube, the internal connecting tube and the internal steel tube to be screwed into the bolt holes in a lower portion of the internal support member;

third, assembling an upper double-steel tube column of the double-steel tube columns above the joint connector to insert an upper end of the internal support member into the upper internal steel tube, insert a lower end of the upper internal steel tube into an upper end of the internal connecting tube, insert the upper external steel tube into an upper end of the external connecting sleeve and insert the first connecting lugs of the external steel tube into the grooves in the upper end of the external connecting sleeve, and enabling the FRP bars to sequentially penetrate through the upper external steel tube, the internal connecting tube and the internal steel tube to be screwed in the bolt holes in an upper portion of the internal support member;

fourth, connecting each second connecting lug to corresponding upper and lower first connecting lugs through a first connecting plate, wherein the upper and lower double-steel tube columns are connected;

fifth, pouring concrete into the double-steel tube columns;

sixth, assembling the two sets of external ring plates vertically symmetrically, connecting the annular portions of the external ring plates to the external steel tubes through the FRP bars, and assembling nuts at ends of the FRP bars; and seventh, assembling the I-beams, connecting the flanges to the horizontal portions of the external ring plates through second connecting plates, and connecting the webs to the first connecting plates.

10. The assembly method according to claim 9, wherein the webs of the I-beams are connected to the first connecting lugs and the second connecting lugs through the first connecting plates.

11. The assembly method according to claim 9, wherein the flanges of the I-beams are connected to the horizontal portions through the second connecting plates.

12. The assembly method according to claim 9, wherein two ends of each FRP bar are tapped with external threads, a first end of the each FRP bar is connected to the internal support member in a threaded manner, and a nut is mounted at a second end of the each FRP bar.

13. The assembly method according to claim 9, wherein the FRP bars are made of carbon fiber reinforced composites.

14. The assembly method according to claim 9, wherein the concrete poured into the double-steel tube columns after assembly is steel fiber reinforced concrete.

15. The assembly method according to claim 9, wherein the internal support member is as high as the internal connecting tube, and the bolt holes in the two ends of the internal support member correspond to the through holes in the two ends of the internal connecting tube.

16. The assembly method according to claim 15, wherein the internal support member comprises circular components at the two ends and a connecting rod in a middle, the circular components at the two ends are connected through the connecting rod, and the bolt holes are regularly formed in the circular components in the circumferential direction.

* * * * *